US005301486A

United States Patent [19]

Taylor

[11] Patent Number: 5,301,486

[45] Date of Patent: Apr. 12, 1994

[54] BRACING SYSTEM

[75] Inventor: John W. R. Taylor, Abbotsford, Canada

[73] Assignee: Western Interlok Systems, Ltd., Langley, Canada

[21] Appl. No.: 806,349

[22] Filed: Dec. 13, 1991

[51] Int. Cl.[5] ..... E04C 3/02

[52] U.S. Cl. ..... 52/695; 52/638; 52/693

[58] Field of Search ..... 52/638, 643, 690, 693, 52/695, 696, 721, 729, 648, 657, 317, 697

[56] References Cited

U.S. PATENT DOCUMENTS

| | | | |
|---|---|---|---|
| 459,900 | 9/1891 | Moore | 52/695 |
| 682,086 | 9/1901 | Kearney | 52/695 |
| 1,514,577 | 11/1924 | Burrell | 52/695 |
| 1,626,393 | 4/1927 | Cater | 52/638 |
| 1,725,414 | 8/1929 | Parish . | |
| 1,734,701 | 11/1929 | White | 52/693 |
| 2,204,566 | 6/1940 | Buelow | 52/695 |
| 2,404,276 | 7/1946 | Cohen | 52/638 |
| 2,467,558 | 4/1949 | Kapnek | 52/690 |
| 2,865,059 | 12/1958 | Scriven | 52/695 |
| 2,914,816 | 12/1959 | Lundren | 52/695 |
| 4,122,647 | 10/1978 | Kovar . | |
| 4,947,612 | 8/1990 | Taylor . | |

*Primary Examiner*—Carl D. Friedman
*Assistant Examiner*—Robert J. Canfield
*Attorney, Agent, or Firm*—Brian M. Long

[57] ABSTRACT

A cross-brace for a pair of joists has inclined brace members extending in vertical X-shaped array and a horizontal member rigidly connecting outer ends of two of the brace members and forming a horizontal strut between the outer ends. The cross-brace has flat lateral extremities, with flat vertical laterally outermost surfaces, for surface-to-surface abutment with opposed sides of the joists, the flat lateral extremities allowing the cross-brace to be entirely accommodated between the opposed sides of the joists.

6 Claims, 6 Drawing Sheets

BRACING SYSTEM

BACKGROUND OF THE INVENTION

1. Field of the Invention

The present invention relates to cross-braces for connection to a pair of parallel joists or beams, and to structural assemblies comprising joists or beams interconnected by cross-braces.

2. Description of the Related Art

In a conventional building construction, floor joists are often provided with braces connecting the joists to resist lateral bending of the joists. Also, it is well known to form such braces as cross-braces, connected between the joists with the brace members extending at an inclination to opposed side faces of the joists.

It is also well known to construct joists as I-beams, comprising an assembly of a pair of chords interconnected by a web member having opposite longitudinal edge portions connected to opposed sides of the chords.

In U.S. Pat. No. 4,947,612, issued Aug. 14, 1990 to John W. R. Taylor et al., there is disclosed a cross-brace comprising elongate brace members assembled to form an X-shaped array, with vertical reinforcement members extending between outer ends of the brace members, as described in greater detail below with reference to the accompanying drawings.

SUMMARY OF THE INVENTION

It is an object of the present invention to provide a further improvement in cross-braces which provides substantially improved lateral support for joists and also improved support for sheet or other material placed on top of or secured beneath the joists.

According to the present invention, there is provided a cross-brace for a pair of joists, comprising inclined brace members extending in a vertical X-shaped array and a horizontal member rigidly connecting outer ends of two of the brace members and forming a horizontal strut between the outer ends; the cross-brace having flat lateral extremities comprising flat vertical laterally outermost surfaces for surface-to-surface abutment with opposed sides of the joists and the flat lateral extremities allowing the cross-brace to be entirely accommodated between the opposed sides of the joists.

In a preferred embodiment of the invention, the cross-brace includes a pair of vertical reinforcement members interconnecting the outer ends of the brace members, the flat lateral extremities comprising flat, vertical, laterally outermost surfaces of the reinforcement members.

For use the I-beams comprising pairs of chords interconnected by webs, the cross-brace may be so adapted that opposite ends of the reinforcement members, together with the outer ends of the brace member, define outwardly-open angular recesses of substantially right-angled cross-section for snugly receiving the chords.

BRIEF DESCRIPTION OF THE DRAWINGS

The invention will be more readily understood from the following description thereof given, by way of example, with reference to the accompanying drawings, in which.

DESCRIPTION OF PRIOR ART

FIGS. 1 through 8 of the drawings illustrate cross-braces illustrated and described in the aforementioned U.S. Pat. No. 4,947,612.

Figure 1:
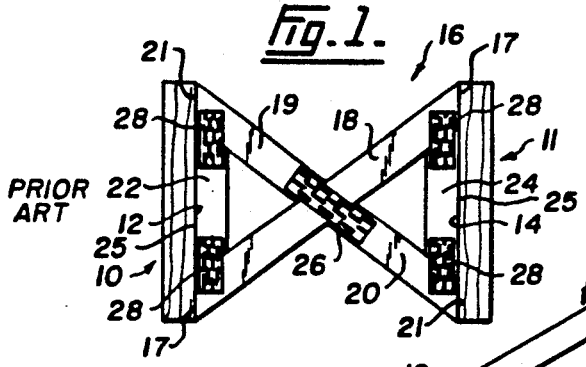
FIG. 1 shows a view in cross-section through parts of a building structure provided with a prior art cross-brace.
Figure 2:
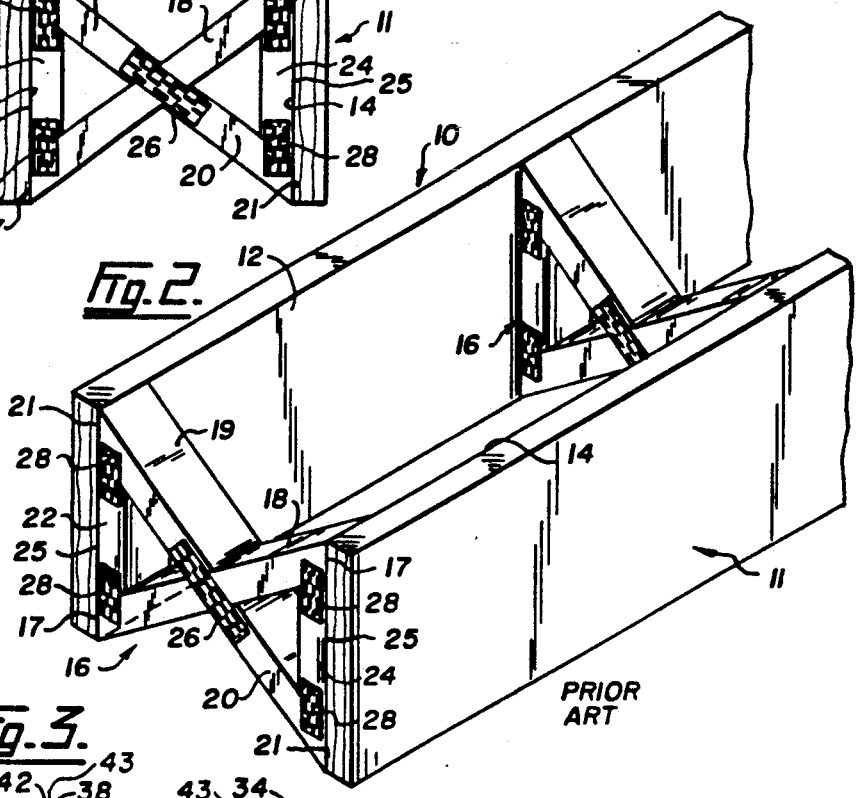
FIG. 2 shows a view in perspective of the structure of FIG. 1.
Figure 6:
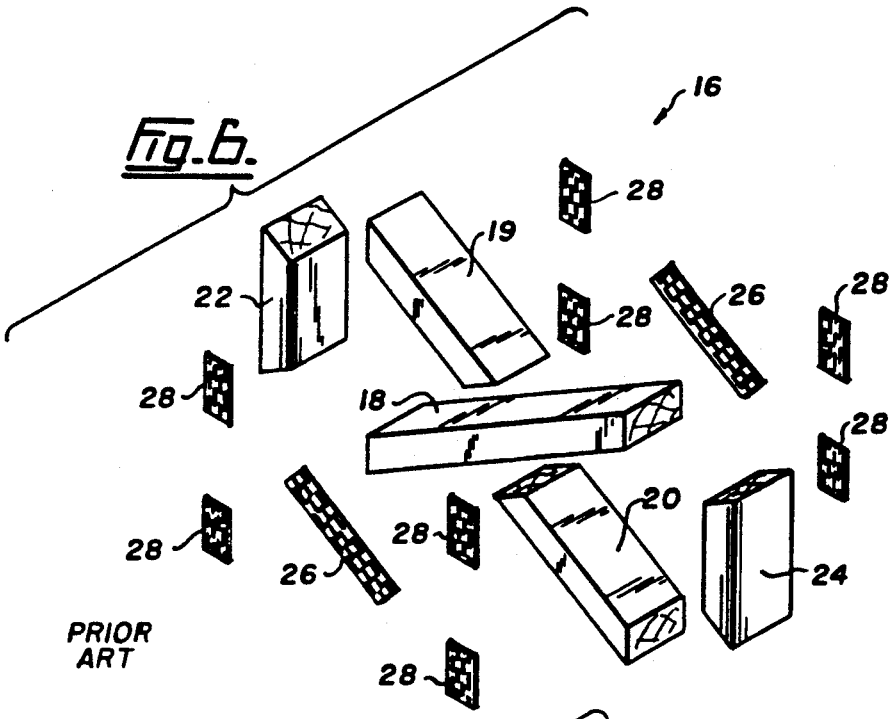
Fig. 6. PRIOR ART
FIG. 6 shows an exploded view, in perspective, of the components of the structure shown in FIGS. 1 and 2.

The structure illustrated in FIGS. 1, 2 and 6 comprises a pair of conventional parallel joists indicated generally by reference numerals 10 and 11, which are of rectangular shape with opposed flat vertical side faces 12 and 14.

A pair of cross-braces, indicated generally by reference number 16, extend between the side faces 12 and 14 for stiffening the joists 10 and 11.

Each of the cross-braces 16 comprises three elongate brace members 18, 19 and 20, which are connected together in an X-shaped array. The brace member 18 is longer than the brace members 19 and 20 and abuts, at opposite end faces 17 thereof, against the surfaces 12 and 14 of the joists 10 and 11. The brace members 19 and 20, on the other hand, have their outer end faces 21 in abutment with the joists surfaces 12 and 14, respectively, but have inner ends thereof in abutment with the brace member 18.

Vertical reinforcement members 22 and 24 extend between the free ends of the brace members 18, 19 and 20 and abut the joist side surfaces 12 and 14.

The end faces 17 and 21 are vertically aligned with outer side faces 25 of the reinforcement members 22 and 24 and form therewith flat vertical lateral extremities of the cross-braces, the tops and bottoms of which are flush with the top and bottom surfaces, respectively, of the joists 10 and 11. Thus, the cross-braces 16 fit between the joists 10 and 11 without projecting vertically upwardly or downwardly beyond the joists 10 and 11 and without obstructing the top and bottom surfaces of the joists 10 and 11.

The brace members 18, 19 and 20 are connected to one another and to the vertical reinforcement members 22 and 24 by means of conventional truss plates 26 and 28.

As will be readily apparent from the above description and from FIGS. 1, 2 and 6, the cross-braces illustrated therein, as compared with conventional cross-braces lacking the reinforcement members 22 and 24, provide additional stiffening for the joists 10 and 11 and thus reinforce these joists against lateral deflection.

Figure 3:
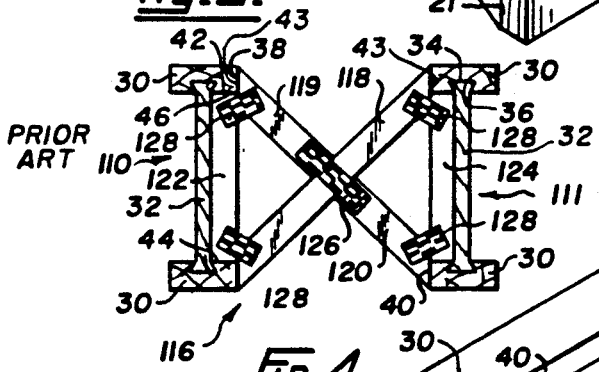
FIG. 3 shows a view taken in vertical cross-section through the structure of FIG. 4.
Figure 4:
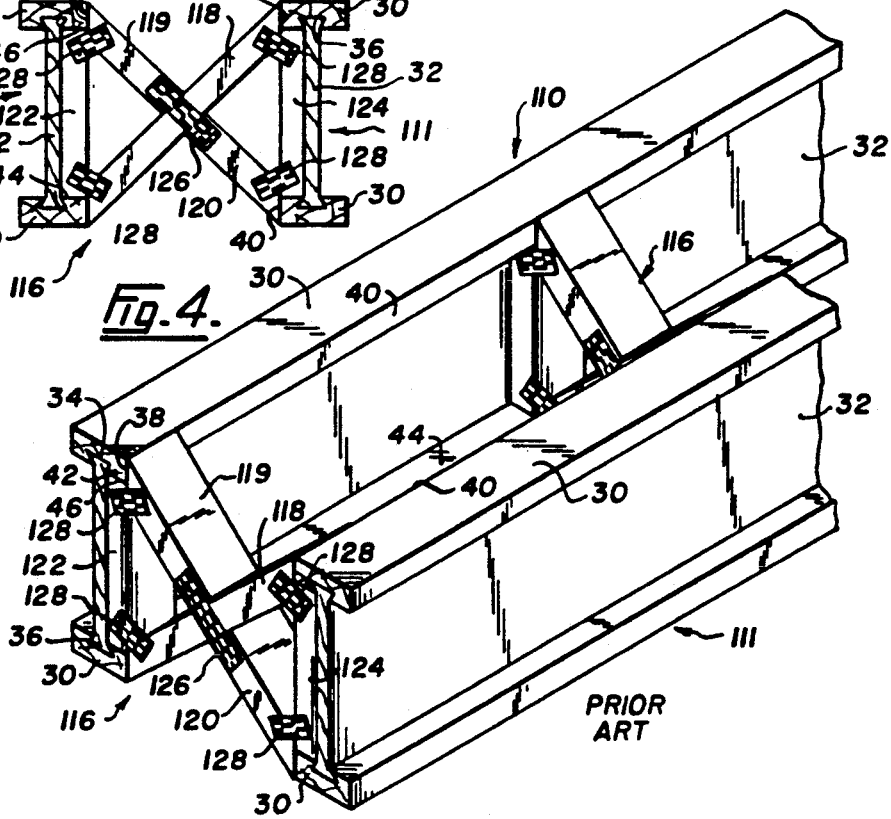
FIG. 4 shows a view in perspective of an I-beam building structure incorporating I-beams and another prior art cross-brace.
Figure 5:
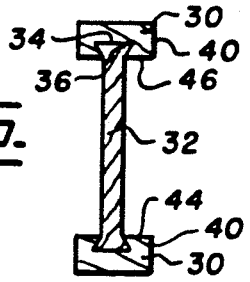
Fig. 5. PRIOR ART
FIG. 5 shows a view in cross-section through an I-beam such as those shown in FIGS. 3 and 4.
Figure 7:
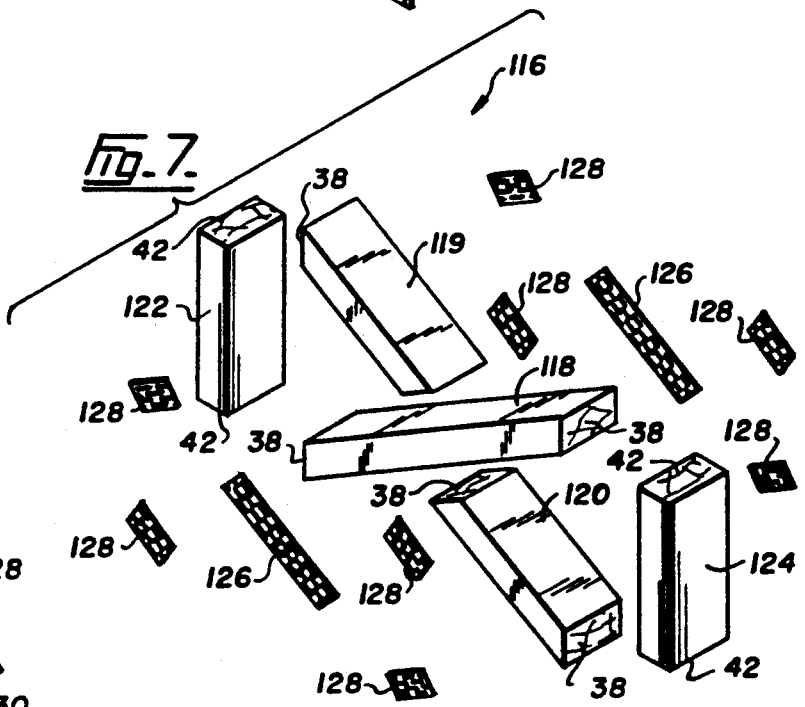
Fig. 7. PRIOR ART
FIG. 7 shows an exploded view, in perspective, of the components of the structure shown in FIGS. 3 and 4.

In FIGS. 3, 4 and 7 of the drawing, parts which correspond to those of FIGS. 1 and 2 have been indicated by the same reference numerals increased by 100.

The structure illustrated as FIGS. 3 and 4 comprises a pair of I-beams, indicated generally by reference numerals 110 and 111.

The beams 110 and 111 are each formed from a pair of beam members of chords 30 interconnected by an intermediate one piece web member 32.

Each web member 32 has longitudinal edge portions 34 which are outwardly divergent to form a solid dovetail-shaped cross-section, so that the edge portions 34 each have a width greater than the thickness of the remainder of the web member 32. The chords 30 are formed with correspondingly-shaped longitudinal slots or recesses 36, which diverge inwardly of the beams 30. The edge portions 34 and the recesses 36 thus interfit snugly to form dovetail joints between the webs 32 and the chords 30. The edge portions 34 and the web 32 are made in one piece, for example, by extrusion. They may be of metal, plastic or wood.

The I-beams 110 and 111 are interconnected by cross-braces 116, which each comprise an X-shaped array of elongate brace members 118, 119 and 120.

The cross-braces 116 also include vertical reinforcement members 122 extending between the outer ends of the brace members 118, 119 and 120.

In this embodiment of the invention, the outer ends of the brace members 118, 119 and 120 present vertical, laterally outwardly directed end faces 38, which abut side faces 40 of the beam members 30, and the reinforcement members 122 present horizontal end faces 42, which abut mutually opposed faces 44 and 46 of the beam members 30.

Thus, the vertical faces 38 and the horizontal faces 42 define outwardly-open angular recesses 43 of substantially rectangular cross-section which snugly receive the beam members 30. Also, the thickness of the reinforcement members 122, in the plane of FIG. 4, is equal to the horizontal spacing of the side faces 40 from the web 32.

The tops and bottoms of the cross-braces 116 are flush with the top and bottom edges, respectively, of the joists 110 and 111 and the reinforcement members 122 and 124 have flat outer surfaces which form flat vertical lateral extremities of the cross-brace 116 and which abut the opposed side faces of the joists 110 and 11.

Figure 8:
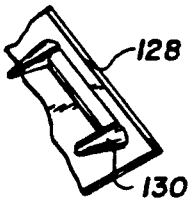
Fig. 8. PRIOR ART
FIG. 8 shows a broken-away view in perspective of a truss plate such as those employed in the structure of FIGS. 1 to 7.

The brace members 118, 119 and 120 are connected together by truss plates 126 and are connected to the reinforcement members 122 by truss plates 128. An example of one of these truss plates, which are of conventional manufacture, is shown in FIG. 8 and is made of sheet metal stamped to form prongs 130 for penetrating engagement in the components of the cross-braces.

DESCRIPTION OF THE PREFERRED EMBODIMENTS

Figure 9:
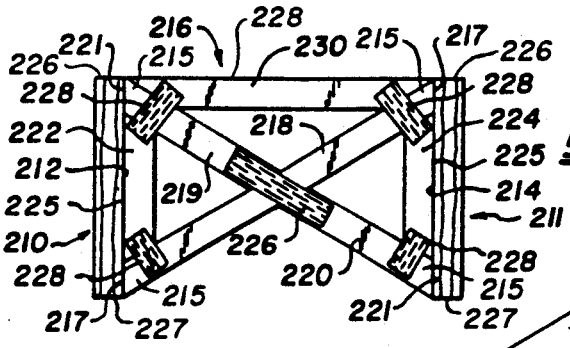
FIG. 9 shows a view in front elevation of a cross-brace according to the present invention.

FIG. 9 shows a cross-brace indicated generally by reference numeral 216, which is a modification according to the present invention of the cross-brace 16 of FIGS. 1 and 2.

Thus, the cross-brace 216 illustrated in FIG. 9 comprises an inclined brace member 218 and a pair of shorter inclined brace members 219 and 220, which are connected together in an X-shaped array.

Between the outer ends of the brace members 218, 219 and 220, there are provided a pair of vertical reinforcement members 222 and 224, which have flat vertical outer faces 225 in vertical alignment with flat vertical end faces 217 of outer ends 215 of the brace member 218 and flat vertical end faces 221 of the brace members 219 and 220.

The cross-brace 216, as illustrated in FIG. 9, is located between and interconnects a pair of parallel vertical joists indicated generally by reference numerals 210 and 211, which have flat horizontal top and bottom edges 226 and 227 and opposed vertical side faces 212 and 214.

The cross-brace 216 further includes a horizontal top member 230 which extends between the outer ends of the brace member 218 and 219 at the top of the cross-brace 216 and which has a flat horizontal edge 228 flush with the top edges 226 of the joists 210 and 211. The faces 225, 217 and 221 form flat lateral vertical surfaces of the cross-brace which intersect the outer edge 228 of the top member 230 and which abut the joist side faces.

The brace members 218, 219 and 220, the reinforcement members 222 and 224 and the horizontal member 230 are connected to one another by conventional truss plates 230 and 228.

Figure 10:
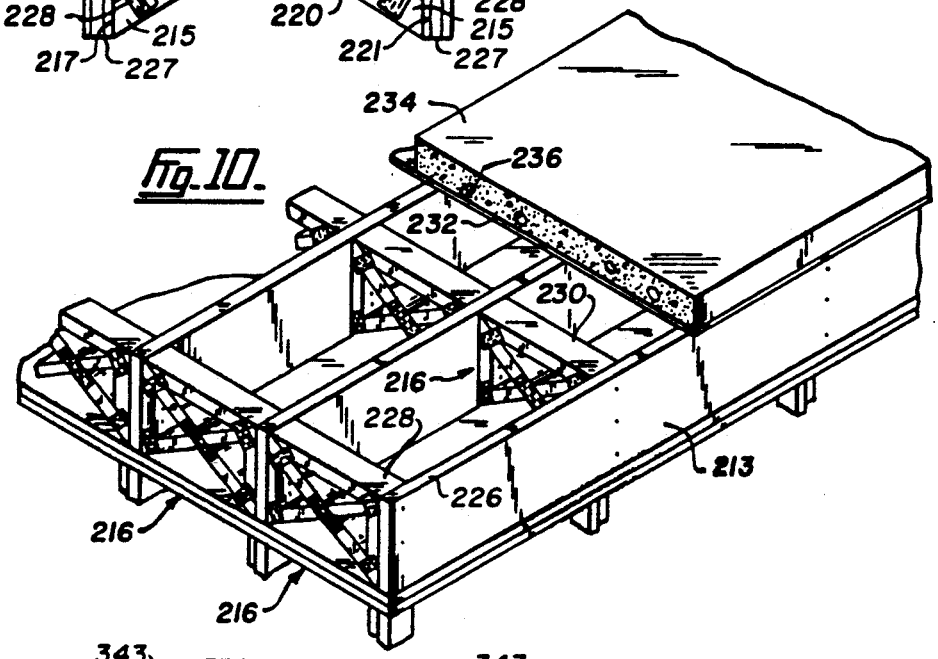
FIG. 10 shows a broken-away view in perspective of parts of a building structure incorporating cross-braces such as that shown in FIG. 9.

FIG. 10 shows a plurality of cross-braces 216 arranged between and connecting joists 210, 211 and 213, of which the latter is the outermost joist of a floor structure. The cross-braces 216 are accommodated entirely between the joists 210, 211 and 213, so that the cross-braces 216 are separated from one another by the joists. The cross-braces 216 are aligned in rows extending transversely of the lengths of the joists, so that, for example, in case of the joists 210 and 211, each cross-brace on one side of one of these joists is disposed directly opposite another cross-brace on the other side of the same joist. Thus, the horizontal members 230 of the cross-braces which are flush with the tops of the joists, form with the latter continuous support surfaces extending transversely of the tops of the joists. This arrangement of joists and cross-braces forms a very strong structure for supporting an overlying sub-floor 232, laid directly onto the tops of the joists and the tops of the horizontal members 230, and supporting on the top of the subfloor 232 a layer of concrete 234, in which heating pipes 236 are embedded. In this way the substantial weight of the concrete 234 is securely supported by the rigid assembly of the underlying joists and cross-braces.

Figure 11:
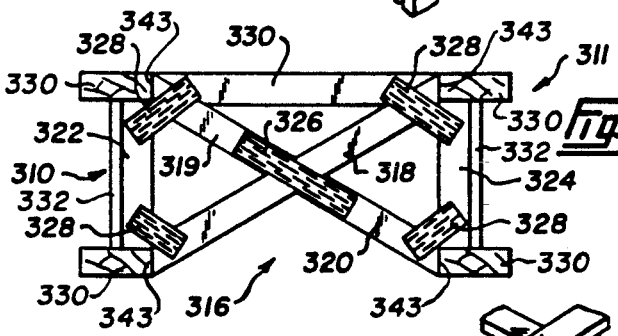
FIG. 11 shows a view in front elevation of a further cross-brace according to the invention.

FIG. 11 shows a cross-brace, indicated generally by reference numeral 316, which is a modification of the cross-brace 116 of FIG. 3 and which, therefore, will not be described in detail. The cross-brace 316 comprises brace members 318, 319 and 320 arranged in an X-shaped array and provided at the ends of the brace-members with vertical reinforcement members 322 and 324.

The cross-brace 316 snugly engages with a pair of I-beams, indicated generally by reference numerals 310 and 311, in a manner similar to the engagement of the cross-brace 116 of FIG. 3 of the I-beams 110 and 111.

In the case of the cross-brace 316 of FIG. 11, however, there is additionally provided a top horizontal bridging member 330, extending between the outer ends of the brace members 318 and 319 at the tops of the cross-brace 316 and having a horizontal outer edge 328 flush with the top edges of the I-beams 310 and 311. The brace members, the reinforcement members and the top horizontal members of the cross-brace 316 are connected together by truss plates 326 and 328.

The cross-brace 316 also has vertically and horizontally outwardly open angular recesses 343 snugly receiving chords 330 of the joists. Vertical reinforcement members 322 and 324 abut joist webs 332.

Figure 12:
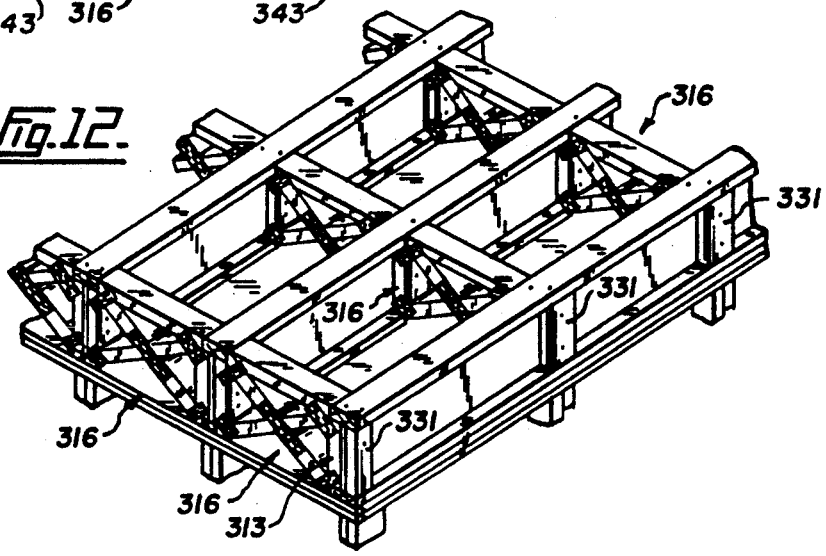
FIG. 12 shows a broken-away view in perspective of parts of a building structure incorporating cross-braces such as that shown in FIG. 11.

As can be seen from the joist structure illustrated in FIG. 12, a plurality of cross-braces 316 are arranged between the joists 310 and 311 and an outermost joist indicated generally by reference numeral 313 and, like the cross-braces 216 of FIG. 10, are arranged in rows extending transversely of the joists. The outer joist 313 is provided with additional reinforcement members 331, opposite ends of which abut the chords of the joist 313.

Figure 13:
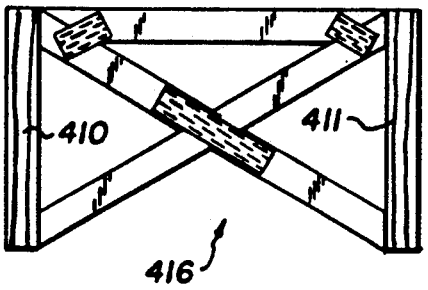
FIG. 13 shows a view in front elevation of a modification of the cross-brace of FIG. 9.

In FIG. 13, there is shown a cross-brace indicated generally by reference numeral 416 which is a modification of the cross-brace 216 of FIG. 9 and in which, more particularly, vertical reinforcement members corresponding to the reinforcement members 222 and 224 of FIG. 9 have been omitted. FIG. 13 also shows a pair of joists 410 and 411, between which the cross-brace 416 is provided.

Figure 14:
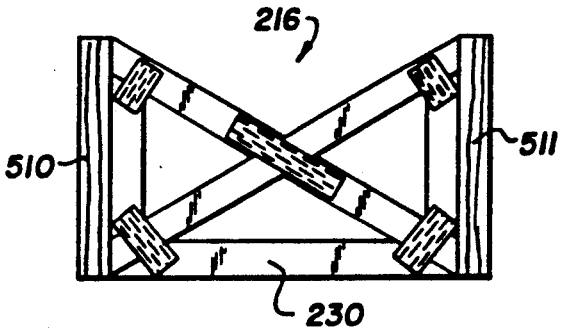
FIG. 14 shows the cross-brace of FIG. 9 in an inverted position.

FIG. 14 shows a pair of joists indicated by reference numerals 510 and 511, between which the brace member 216 of FIG. 9 is located in an inverted position. As can be seen from FIG. 14, the horizontal member 230 of the cross-brace 216 is horizontally flush with the undersides of the joists 510 and 511. Thus, a panel of material, for example a panel of plaster-board, can be readily nailed to the undersides of the joists 510 and 511 and the underside of the horizontal members 230 of a plurality of the cross-braces 216.

Figure 15:
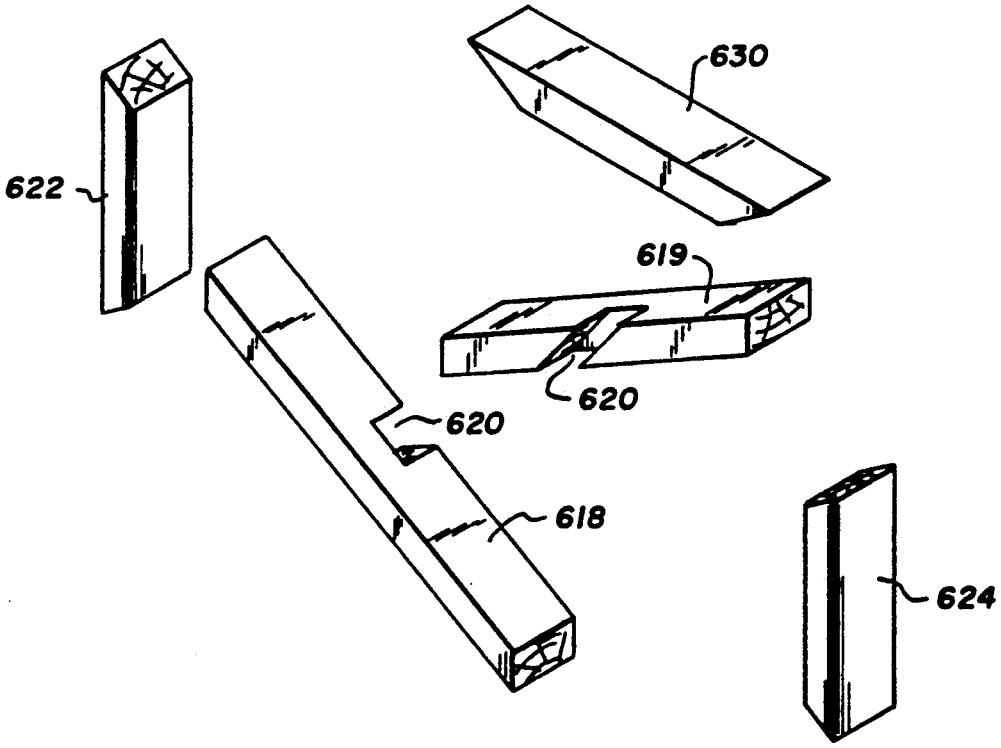
FIG. 15 shows an exploded view, in perspective, of components of the cross-brace of FIG. 9.

As will be readily apparent to those skilled in the art, the X-shaped array of the brace members of the above-described cross-braces, instead of being made up from three separate components, may be made from a pair of brace members 618, 619, as shown in FIG. 15, these brace members each being formed with a slot 620 enabling the brace member 618 and 619 to be connected together by a lap joint.

For a completeness, vertical reinforcement-members 622 and 624 and a horizontal member 630, similar to the corresponding members in FIG. 9, have also been shown in FIG. 15.

In each of the cross-braces shown, the brace members have a rectangular cross-section the major dimension of which is perpendicular to the plane of the X-shaped array of the respective cross-brace.

The above-described structures may be made of wood, plastic, metal or any combination thereof.

The inclusion of the horizontal members 230, 330 and 630 or the like provides a number of advantages.

Figure 16:
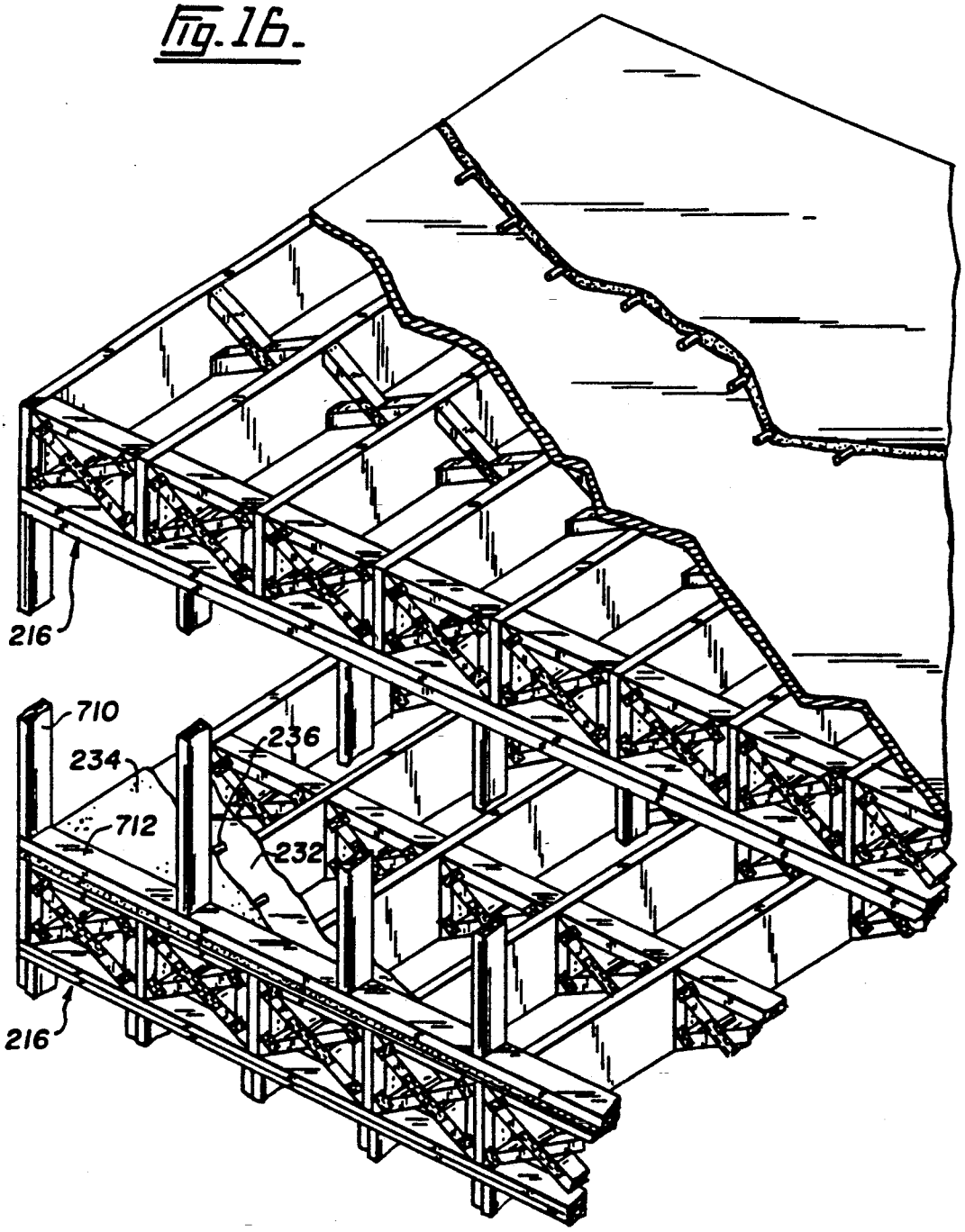
FIG. 16 shows a broken-away view in perspective of parts of two stories of a building using cross-braces as shown in FIGS. 9 and 10.
Figure 17:
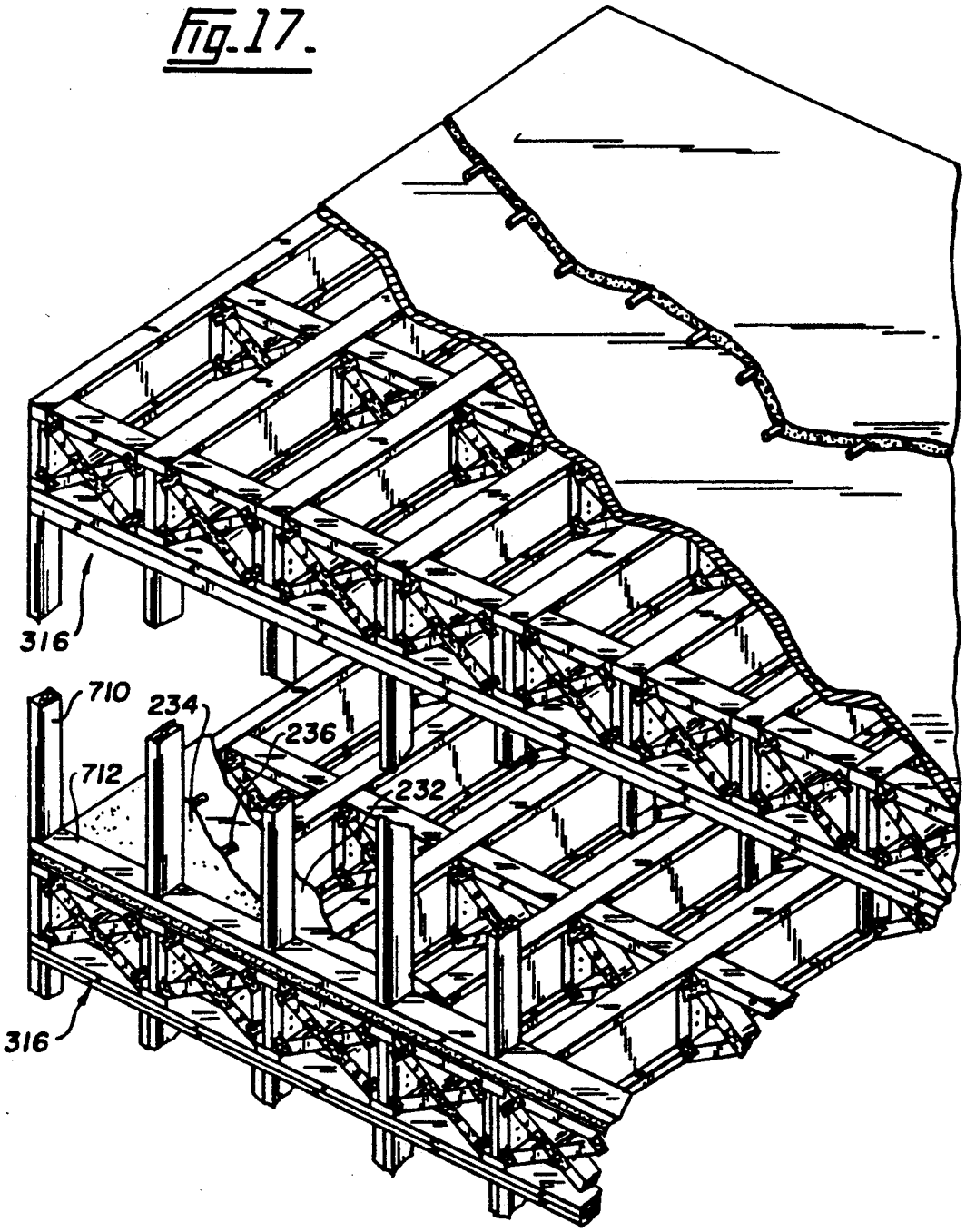
FIG. 17 shows a broken-away view in perspective of parts of two stories of a building using cross-braces as shown in FIGS. 11 and 12.

Thus, when the braces are provided with the horizontal members and aligned with one another as shown, for example, in FIGS. 16 and 17, the braces at the extremities of the joists, and/or intermediate the extremities can form a load bearing support for an overlying wall comprising studs 710 and a plate 712. As those skilled in the art will appreciate, it has previously been necessary to provide crush blocks for that purpose.

The tops of the horizontal members provide nailing surfaces for the nailing of overlying and mutually abutting edges of sheets of plywood.

Consequently, the plywood is better secured than would otherwise be the case, and plywood squeaks and floor squeaks are at least partially eliminated. Also, these horizontal members provide additional support for the overlying concrete and thus counteract cracking of the concrete and also counteract bending and other distortions of the in-floor heating pipes.

Wooden joists usually exhibit a degree of crowning and construction workers generally take care to lay the joists with the crowning uppermost. When the present braces are used, and are nailed down to an underlying support after being nailed to the joists, they have the effect of pulling down the joists and thus by reducing or even eliminating the crowning. This promotes greater evenness or uniformity of any overlying floor decking or concrete.

With the present braces, spanning joists support one another, and are supported by side walls, so that they are not solely reliant on end walls for support.

The nailing of the plywood to the horizontal members and the provision of the present braces between the joists support the plywood edges between the joists, so that these edges do not depend on butt joints or tongue and groove joints between the plywood edges at the locations for support.

The horizontal members also connect the joists to one another, when the braces are nailed to the joists, so that each joist is supported by the adjacent joist or joists against horizontal deflection, thus providing a load sharing effect between the joist. Thus, the horizontal members act as bridging, so that each joist or truss acts with those next to it in a load sharing manner to resist jointly the loads they must carry and to counteract deflection from non-uniform loads.

Also, the horizontal members help to prevent sideways buckling and roll-over of the joists before and while the decking is installed thus avoiding any need for temporary bracing of the joists, and additionally ensures that, as the joists are installed, they are positioned so as to be accurately spaced from and parallel to one another and accurately vertical, i.e. plumb, which is required for maximum load sharing. The cross-braces also substantially stiffen the joists.

As will be apparent to those skilled in the art, various other modifications may be made-to the above-described embodiments for the invention.

For example, while the basic X-shaped cross-brace shown in FIG. 1 is made up of three components, namely the brace members 18, 19 and 20, and that shown in FIG. 15 comprises two brace members 618 and 619, it is alternatively possible to manufacture this X-shaped cross-brace in one piece, e.g. by an extrusion or molding process, e.g. from wood products, metal or plastic material.

I claim:

1. A structural assembly, comprising:

a plurality of joists, said joists having opposed vertical side faces spaced apart from one another;

a plurality of cross-braces accommodated entirely between said joists, so that said cross-braces are separated from one another by said joists, and interconnecting said joists;

said joists having flat horizontal edges;

said cross-braces each having a flat horizontal edge flush with said horizontal edges of said joists;

said cross-braces each comprising a pair of inclined brace members connected in a vertical X-shaped configuration and having outer ends and a horizontal member extending between said outer ends of said brace members and forming a horizontal strut between said outer ends; and said cross-braces having flat lateral vertical surfaces intersecting said outer edges of said cross-braces and abutting said opposed side faces of said joists.

2. A structural assembly as claimed in claim 1, wherein said cross-braces each include a pair of vertical reinforcement members interconnecting said outer ends of said brace members, said vertical reinforcement members abutting said vertical side faces of said joists.

3. A structural assembly as claimed in claim 1, wherein said joists comprise I-beams having upper and lower horizontal chords and vertical web members interconnecting said chords, and wherein said cross-braces include vertical reinforcement members interconnecting said outer ends of said brace members, said reinforcement members having flat vertical outer faces abutting said webs, said cross-braces being formed with outwardly vertically and horizontally open angular recesses and said recesses snugly receiving said chords.

4. A structural assembly as claimed in claim 1, wherein said horizontal edges of said cross-braces are flush with said horizontal edges of said joists at the tops of said joists.

5. A structural assembly as claimed in claim 1, wherein said cross-braces are aligned in rows extending transversely of the lengths of said joists, with said outer edges of said cross-braces flush with the tops of said joists.

6. A structural assembly as claimed in claim 5, further comprising a sub-floor supported on and in contact with said outer edges of said cross-braces and the entire areas of the tops of said joists.

* * * * *